United States Patent [19]

Fabian et al.

[11] 4,367,832

[45] Jan. 11, 1983

[54] LOOP LIFTER

[75] Inventors: Wolfgang Fabian, Dortmund; Horst Heinen, Waltrop; Theodor Sevenich, Dortmund, all of Fed. Rep. of Germany

[73] Assignee: Hoesch Werke Aktiengesellschaft, Dortmund, Fed. Rep. of Germany

[21] Appl. No.: 133,355

[22] Filed: Mar. 24, 1980

[30] Foreign Application Priority Data

Mar. 26, 1980 [DE] Fed. Rep. of Germany ..... 2911881

[51] Int. Cl.[3] ..... B65H 17/54; B21B 39/20

[52] U.S. Cl. ..... 226/108; 72/205; 72/250; 226/118; 226/200; 242/78.1

[58] Field of Search ..... 226/113, 114, 199, 200, 226/118, 119, 104, 108; 242/78.1, 79, 80, 76; 72/205, 227, 250

[56] References Cited

U.S. PATENT DOCUMENTS

| | | | |
|---|---|---|---|
| 3,206,961 | 9/1965 | Bailey | 72/205 X |
| 3,237,439 | 3/1966 | Torrance | 72/205 |
| 3,381,906 | 5/1968 | Whitehouse et al. | 242/78.1 |
| 3,645,120 | 2/1972 | Lind et al. | 242/78.1 X |
| 3,744,288 | 7/1973 | Wykes | 72/205 X |
| 3,782,162 | 1/1974 | Bullard | 72/250 |
| 4,033,492 | 7/1977 | Imai | 72/205 X |

FOREIGN PATENT DOCUMENTS

| | | | |
|---|---|---|---|
| 2427857 | 2/1980 | France | 242/78.1 |

*Primary Examiner*—Stanley N. Gilreath
*Attorney, Agent, or Firm*—Max Fogiel

[57] ABSTRACT

A loop lifter for continuous strip rolling mills has an arm which is journalled in a support for pivotal movement about a horizontal axis. An end portion of the arm carries a freely turnable roll which can engage a loop from below and lift it upwardly. A counter balancing spring reacts between a fixed pivot and the arm and assures that the pivot shaft for the arm is not subject to any free torque during pivoting movement of the arm between 0° and 90° of arc.

6 Claims, 5 Drawing Figures

LOOP LIFTER

BACKGROUND OF THE INVENTION

The present invention relates to a loop lifter, and more particularly to a loop lifter for continuous strip rolling mills.

In continuous strip rolling mills the rolled strip forms pendant loops between successive roll stands. For manufacturing reasons it is necessary to maintain these loops at a certain height and to maintain the strip tension as low and as constant as possible. For this purpose it is known to provide so-called loop lifters which engage the pendant loops from below and exert upwardly directed support for them. Such loop lifters have a pivotable arm provided at one end portion thereof with a so-called loop-lifting table in which a roll is journalled for free pivotable turning about a horizontal axis; it is this roll which engages the loop from below. The arm is made to pivot upwardly so that the roll engages the loop from below, by means of a drive. The construction of the drive is determined by three factors, namely the moment required for compensating the inherent weight of the loop lifter itself, the moment required for compensating the weight of the loop as it is pendant between two successive roll stands, and the moment required for compensating the strip tension. It is readily appreciable that the moment required to compensate the inherent weight of the loop lifter amounts to a substantial portion of the drive moment required for effecting the upward pivoting of the arm.

One known construction of a loop lifter utilizes a lever or arm which is pivotable in a fixed pivot point and which carries the aforementioned roller for engaging the loops from below. It is also known to provide a loop lifter in which an attempt has been made to reduce the swing moment of the loop lifter by mounting the roll not in a pivotable arm, but instead in a carriage which can be moved in vertical guides. In all prior-art loop lifters the engagement of the roll with the respective loops is effected either by means of hydraulic cylinders, pneumatic cylinders for electric motors which pivot the arm or move the carriage. To avoid fluctuations in the strip tension, which causes variations in the thickness and width of the strip being formed, the swing moments of the loop lifter itself, and the drive for the loop lifter, must be maintained as small as possible. Small swing moments for the drives can be obtained if hydraulic or pneumatic drives are used, but the exact regulation of the drive torque is possible in these types of drives. If an electric motor is used to drive the loop lifter, then the drive torque can be regulated very exactly but, on the other hand, the swing moments of the drive, particularly if a transmission is arranged between the motor and the loop lifter, are very substantial.

Another proposal that has been made in the art is to reduce the motor torque in loop lifters which utilize electric motors for their drive, by compensating for the weight of the roll and the arm carrying the same via a counterweight. Although this does not reduce the motor torque, it does not reduce the total swing moment and this measure is therefore also not fully satisfactory.

SUMMARY OF THE INVENTION

It is, accordingly, a general object of this invention to avoid the disadvantages of the prior art.

A more particular object of the invention is to provide a loop lifter for use in strip-rolling mills in which the torque of the loop lifter drive is reduced.

Still more particularly, an object of the invention is to provide a loop lifter of the type mentioned above in which the reduction of the loop lifter drive torque does not result in an increase of the swing moment of the loop lifter components.

Still a further object of the invention is to provide a loop lifter of the type outlined above which permits the use of smaller drive motors which, in turn, leads to a reduction in the cost of manufacture and sale of such equipment and in a concomitant reduction in the energy requirements for operating this equipment.

Pursuant to the above objects, and to others which will become apparent hereafter, one aspect of the invention resides in a loop lifter for continuous strip rolling mills in which the strip forms pendant loops, such loop lifter comprising, briefly stated, a support, an elongated arm, and a shaft journalling the arm in the support for pivotal movement about a substantially horizontal first axis so that one end portion of the arm can bear from below against a respective loop and lift the same. Further, there is provided counter balance means including a spring reacting between the one end portion of the arm and a stationary abutment. This counter balance means counter balances the weight acting upon the one end portion, such that during pivoting of the one end portion between 0° and 90° of arc no free torque is present at and acts upon the shaft.

It is advantageous if the spring is connected to a lever which is mounted on the shaft outside the confines of the support and which can turn with but not relative to the shaft. A particularly advantageous construction is obtained if the spring constitutes part of a separate unit or aggregate which is mounted adjacent to the loop lifter in a separate frame and which is connected with the loop lifter via an appropriate coupling.

It has also been found to be advantageous if the distance of the fixed pivot for the spring from the axis of rotation of the shaft journalling the arm equals the length of the lever which is mounted outside the confines of the support and to which the spring is connected.

A currently preferred embodiment of the invention proposes for the spring to be mounted in a hollow cylinder through one end of which a slidable rod extends which carries at its inner end an abutment, the spring surrounding the rod within the cylindrical housing and bearing with its opposite ends against the abutment and the aforementioned one end of the housing. This one end, incidently, is advantageously of bifurcated configuration.

A loop lifter constructed in accordance with the present invention reduces the torque of the loop lifter drive and permits the use of smaller drive motors. This, in turn, results in a not insignificant reduction of the costs for constructing the loop lifter and also in a corresponding advantageous reduction in the energy costs required for operating the loop lifter. In addition, it should be noted that the prior-art loop lifters can be readily converted to the construction according to the present invention if it is desired to save energy, since the spring respectively the spring unit can be readily installed in such existing devices. There is also the fact that the spring respectively the spring unit is located outside the immediate surroundings of the strip passage, i.e. the path in which the strip travels, so that it can be readily serviced.

Embodiments of the invention will hereafter be described with reference to the appended drawings. It should be understood, however, that these are merely exemplary in nature and that the inventive scope for which protection is being sought is defined exclusively in the appended claims.

DESCRIPTION OF PREFERRED EMBODIMENTS

Figure 1:
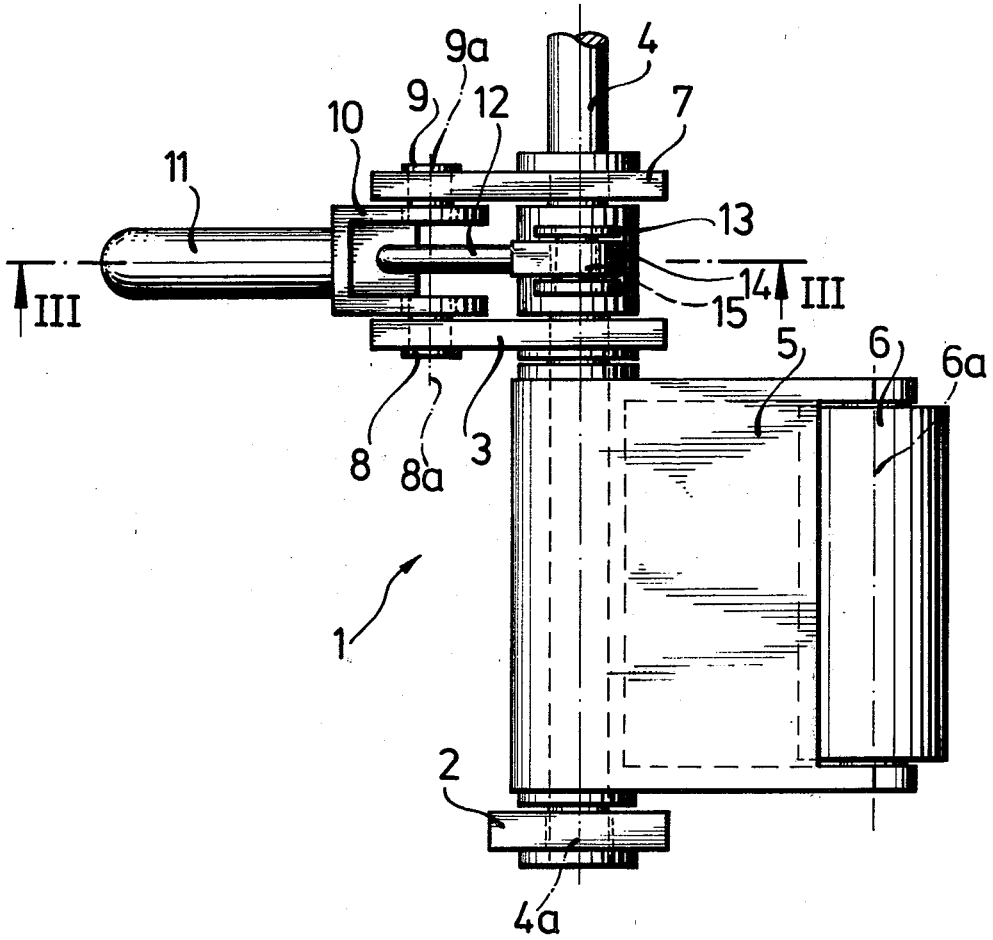
FIG. 1 is a somewhat diagrammatic top-plan view illustrating a loop lifter according to the invention.

A first embodiment of the invention is illustrated in FIGS. 1–4, wherein the loop lifter is identified with reference numeral 1. It is composed of two laterally spaced supports 2, 3 in which a shaft 4 is journalled which constitutes a fixed pivot for the arm carrying the so-called lifting table 5 which is pivotally mounted on the shaft 4 and which is provided, at a free end remote from the shaft 4, with a roll 6 that is turnably journalled in the table 5 for free turning movement about a diagrammatically illustrated axis 6*a* that extends parallel to the axis 4*a* of the shaft 4. The spacing of the supports 2, 3 substantially to the width of the table 5. The drive for pivoting the table 5 about the axis 4*a* into and out of engagement of the roll 6 with the not illustrated pendant loops of roll strip, is not illustrated because it forms no part of the invention and is known per se in the art.

A plate 7 is secured to the support 3, spaced therefrom in the direction of the axis 4*a* and the shaft 4 extends not only to the support 3 but also to the plate 7 and in fact outwardly beyond the same. Pivots 8 and 9 are mounted in the support 3 and the plate 7, in axial alignment with one another and in parallelism to the axis 4*a* of the shaft 4. These pivots or pins 8 and 9 serve as the journals and fixed pivot point in the support 3 and plate 7 for the bifurcated end portion 10 of a spring cylinder unit 11 (see particularly FIG. 3) having a slidable rod 12 which extends into the interior of the unit 11 through the end portion having the end 10 and which is provided in the interior with an abutment 12*a*. The spring 19 surrounds the rod 12 within the unit 11 and bears upon the abutment 12*a* and the end portion 10, respectively.

A lever 13 of bifurcated configuration (see particularly FIG. 1) is mounted on that portion of the shaft 4 which extends outwardly beyond the support 3, i.e. it is mounted intermediate the support 3 and the plate 7. The bifurcated lever 13 is connected to the shaft 4 (in a manner known per se from the prior art) so that it can turn with but not relative to the shaft 4. The outer end portion of the rod 12, i.e. the one which projects outwardly of the unit 11 past the end 10 thereof, is identified with reference numeral 14 and is configurated as an eye so that it can be turnably connected to the free end of the lever 13 by means of a bolt or a similar element 15.

Figure 3:
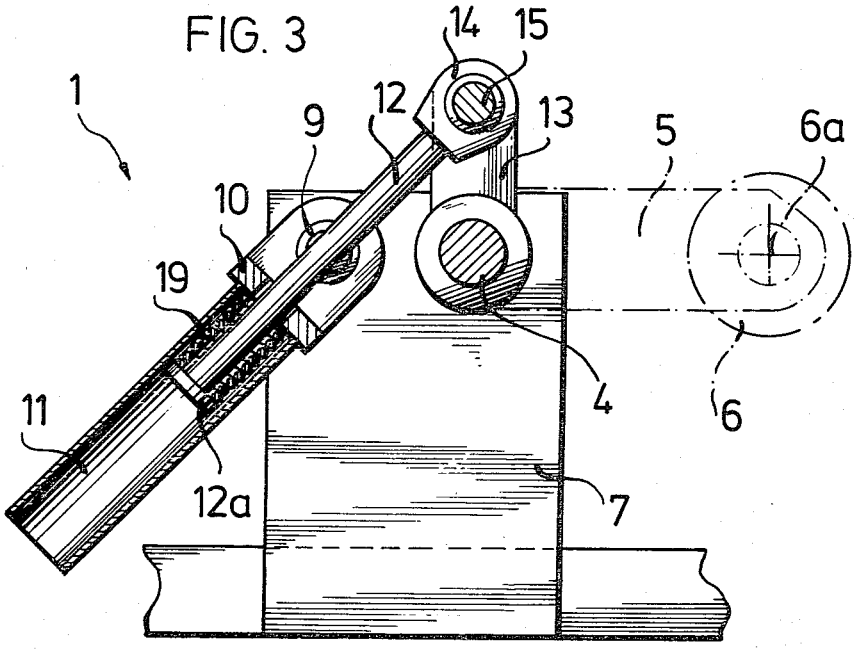
FIG. 3 is a section taken on line III—III of FIG. 1.
Figure 4:
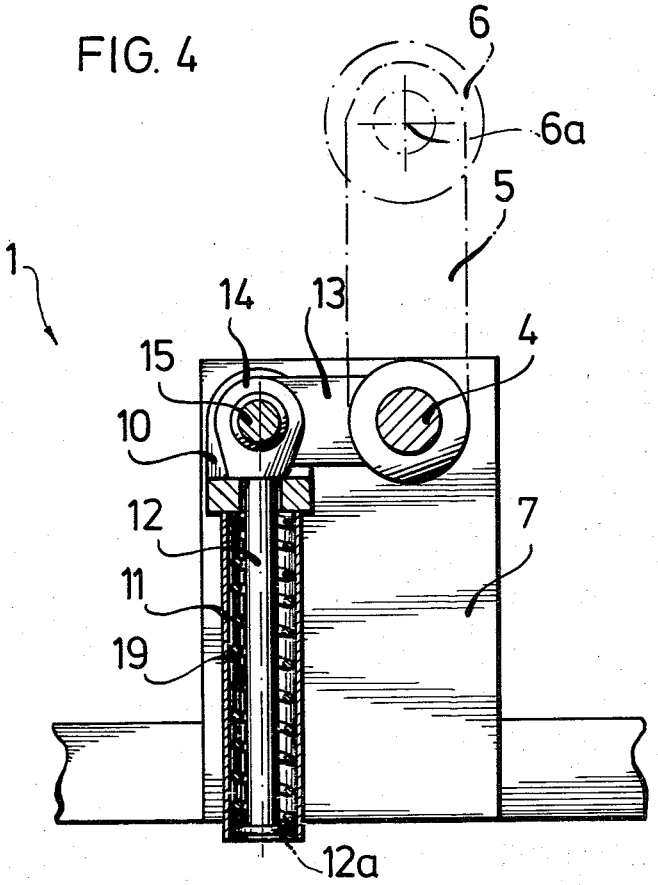
FIG. 4 shows the same section as in FIG. 3, but with the roll of the loop lifter pivoted through 90° in upward direction.
Figure 5:
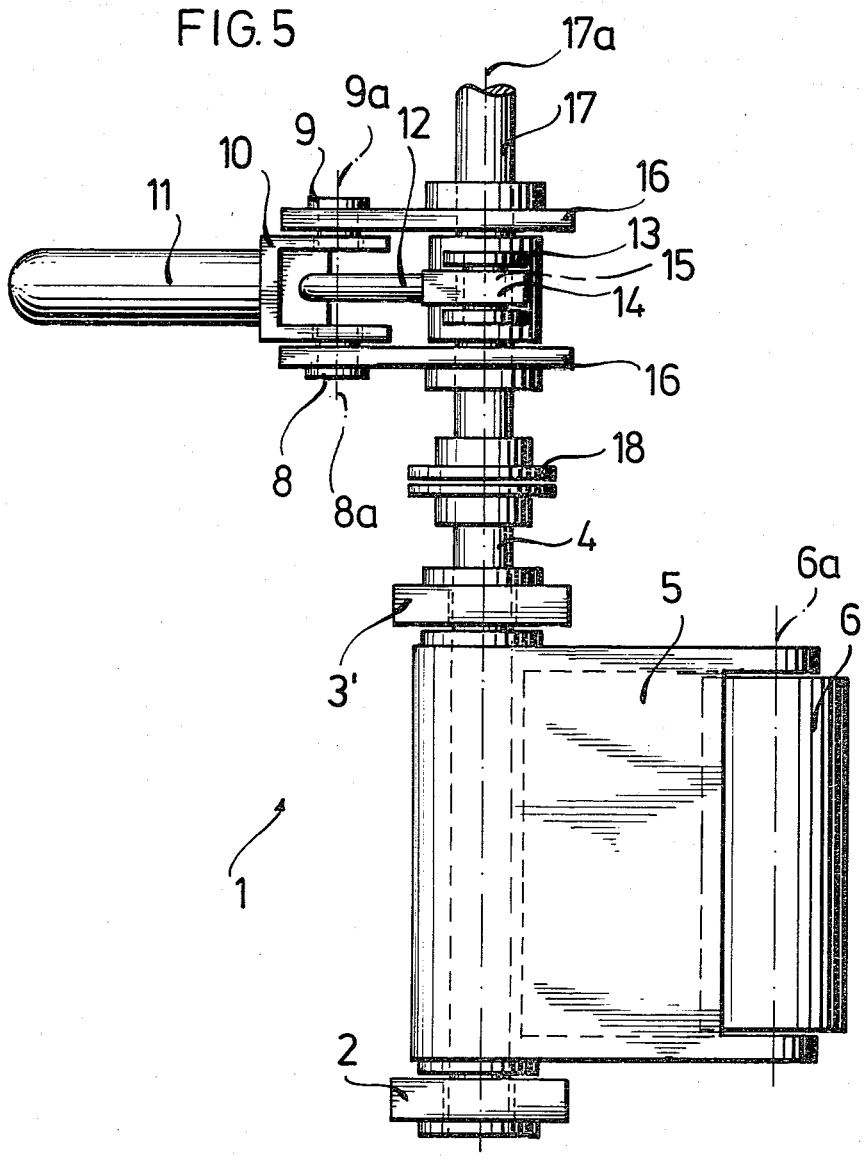
FIG. 5 is a top-plan view illustrating another embodiment of the invention.

The embodiment in FIG. 5 differs from the one in FIGS. 1–4 only in that the spring unit 11 is not mounted to the support 3 and the plate 7, but instead in a separate frame 16 which is located laterally of the supports 2, 3 and table 5. This frame 16 is provided with a shaft 17 on which the lever 13 is mounted in the same manner as it was connected to the shaft 4 in FIGS. 1–4, i.e. so that it can turn with but not relative to the shaft 17. The shaft 17 is in axial alignment with the shaft 4 and a coupling 18 (known per se in the art) is provided by means of which the two shafts 4 and 17 can be coupled for joint rotation or can be disengaged from one another. All other components are the same in FIG. 5 as in FIGS. 1–4 and therefore have the same reference numerals and the same functions.

Figure 2:
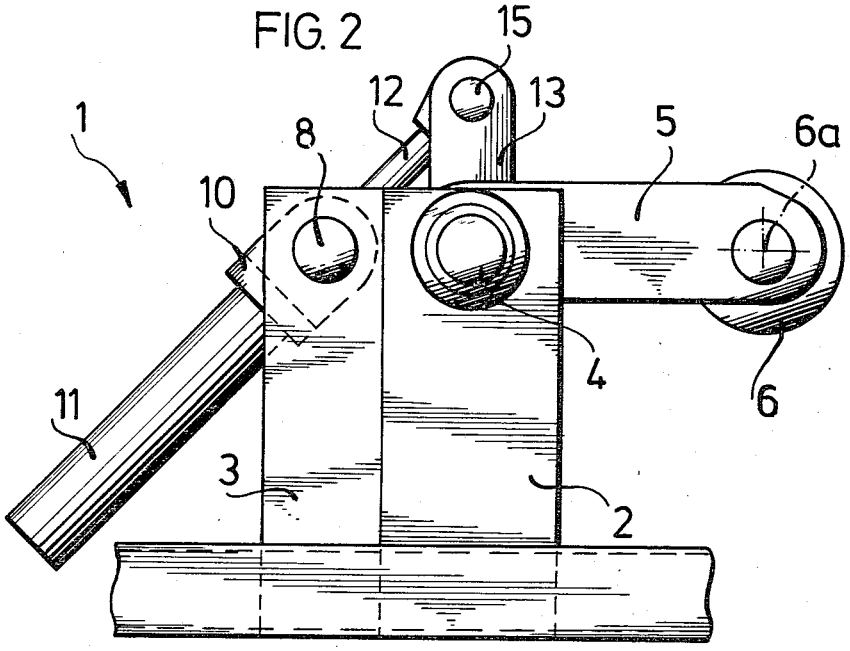
FIG. 2 is a side view of the loop lifter of FIG. 1.

In FIG. 2 the table 5 is shown in its inoperative horizontal position, as it is in FIG. 3 in broken lines, and in FIG. 4 it is shown in its vertically pivoted position; it is this position in which the roll 6 is displaced through 90° relative to the position in FIGS. 2 and 3, or any position intermediate the position of FIG. 4 and the positions of FIGS. 2 and 3, in which the roll 6 engages a respective loop from below and lifts it upwardly.

The spacing of the axis 8*a*–9*a* on which the two pivots 8 and 9 are aligned (both in the embodiment of FIGS. 1–4 and the embodiment of FIG. 5) from the axis 4*a* of the shaft 4 or, in FIG. 5, the axis 17*a* of the shaft 17, is equal to the distance from the pivot point of the end portion 14 at the lever 13 to the axis 4*a* of the shaft 4 respectively the axis 17*a* of the shaft 17. Due to this choice of distances, and the fact that the end portion 10 of the unit 11 is bifurcated, the free end of the lever 13 can, in response to a turning movement of the lever 13 through 90° in the direction towards the unit 11, enter with the bolt 13 and the end portion 14 of the rod 12, far enough into the bifurcated end portion 10 of the unit 11 that the pivots 8 and 9 move into axial alignment with the bolt 15. This assures that in case of the relaxation of the compensating spring 19 in the unit 11 from a maximum spring force (required for balancing the weight of the table 5 and roll 6 in the horizontal position of FIGS. 2 and 3) to the value 0 when the table 5 and roll 6 are pivoted through 90° upwardly to the position of FIG. 4, the weight of the table 5 and the roll 6 is fully compensated in any position which these two components can assume intermediate a zero degree of arc position (FIGS. 2 and 3) and the 90° of arc position (FIG. 4).

Although the invention has been described with reference to two exemplary embodiments it is to be understood that this is only for purposes of explanation and that the scope of protection sought for the invention is determined exclusively by the appended claims following hereafter.

What is claimed is:

1. A loop lifter for continuous strip-rolling mills in which the strip forms pendant loops, comprising: a support having a stationary abutment; an arm having a free end portion; a shaft rotatably supported by said support, said arm being connected to said shaft for pivotal movement about a substantially horizontal first axis so that the free end portion of the arm can bear from below against a respective loop and lift the same; spring means reacting between said arm and the stationary abutment for counter balancing the arm weight in all positions of action; said arm including a roll freely turnably journalled in said free end portion of said arm on a substantially horizontal second axis and engageable with the respective loop; a lever having a free end and mounted on said shaft for rotation therewith; said spring means reacting between the free end of said lever and the stationary abutment; said spring means having a pivot; the distance of said pivot from said first axis being equal to the length of said lever; said spring means including a cylindrical housing mounted on said pivot; a rod extending coaxially and slidably into said housing through one housing end thereof and having an inner end provided with an auxiliary abutment and an outer end connected to said lever, and a spring surrounding said rod and having opposite end portions bearing upon said auxiliary abutment and said one housing end, respectively; said one housing end being of bifurcated configuration.

2. A loop lifter as defined in claim 1, wherein said lever and said arm include a right-angle.

3. A loop lifter as defined in claim 1, wherein said shaft has a shaft portion extending outwardly beyond said support, said lever being mounted on said extending shaft portion.

4. A loop lifter as defined in claim 1, wherein said spring means comprises further an independent unit installed in a separate frame adjacent to said arm; and coupling means for connecting said spring means with said arm.

5. A loop lifter as defined in claim 1, including a frame adjacent said support, said spring means being mounted in said frame; and a coupling connecting said spring means with said shaft.

6. A loop lifter as defined in claim 1, wherein said spring means reacts between said arm and said stationary abutment such that during pivoting of said one end portion between 0° and 90° of arc no free torque is present at and acts upon said shaft.

* * * * *